United States Patent [19]

Ishii et al.

[11] Patent Number: 4,907,507

[45] Date of Patent: Mar. 13, 1990

[54] OPERATING LEVER MECHANISM FOR OFFSET PRINTING PRESS

[75] Inventors: Koji Ishii; Naoki Ikeda, both of Fuchu, Japan

[73] Assignee: Ryobi Ltd., Hiroshima, Japan

[21] Appl. No.: 344,578

[22] Filed: Apr. 28, 1989

[30] Foreign Application Priority Data

May 6, 1988 [JP] Japan ..... 63-110723

[51] Int. Cl.[4] ..... B41F 7/06; B41F 7/40; B41F 31/30

[52] U.S. Cl. ..... 101/142; 101/148; 101/352

[58] Field of Search ..... 101/132, 132.5, 141, 101/142, 144, 148, 145, 247, 218, 232, 351, 352, 207–210

[56] References Cited

U.S. PATENT DOCUMENTS 2,967,475 1/1961 Ritzerfeld ..... 101/144

3,155,036 11/1964 Ritzerfeld ..... 101/144

3,956,985 5/1976 Ishii .

4,676,156 6/1987 Aylor et al. .

*Primary Examiner*—J. Reed Fisher

*Attorney, Agent, or Firm*—Sughrue, Mion, Zinn, Macpeak & Seas

[57] ABSTRACT

An offset printing press having an operating lever mechanism which is capable of controlling sequential printing operations by manipulating a single operating lever. The offset printing press includes an inking roller system and a dampening roller system. The inking roller system is supported to a first pair of frames, while the dampening roller system is supported to a second pair of frames pivotable relative to the first pair of frames. The operation lever provides pivotal motion of the second pair of frames for selectively applying water to a plate cylinder from the dampening roller system. Further, rollers in the dampening roller system are movable toward and away from each other.

8 Claims, 7 Drawing Sheets

OPERATING LEVER MECHANISM FOR OFFSET PRINTING PRESS

BACKGROUND OF THE INVENTION

The present invention relates to an operating lever mechanism for an offset printing press.

Generally, an offset printing press includes a plate cylinder for mounting thereon a master plate, a blanket cylinder, an inking roller system and dampening roller system. In the dampening roller system, a fountain pan and a water applicator roller are provided so as to apply water in the pan to the plate cylinder by the applicator roller. U.S. Pat. No. 3,956,985 assigned to Ryobi. Ltd. (corresponding to Japanese Patent Publication No. 55-16069) discloses a single operating lever which is steppingly tiltable so as to control sequential printing operation starting from an ink application to the plate cylinder. More specifically, the operating lever is connected to an operation shaft which is stepwisely rotated about its axis upon steppingly tilting operation of the operation lever. The operation shaft is fixely provided with cams and arms those being mechanically associated with a form roller or an ink applicator roller, the plate cylinder, the blanket cylinder and a limit switch. Therefore, the rotations of the cams and movements of the arms will provide ON/OFF switching of the limit switch and will provide rotations of the plate and blanket cylinders and movement of the ink applicator roller.

However, according to this structure, the dampening system or water application system to the plate cylinder is continuously operated during actuation of the offset printing press, so that dampening liquid or water is always supplied from the fountain pan to the water applicator roller. As a result, excessive water may be applied to the plate cylinder, to thereby degrade printing quality at an initial stage of printing.

U.S. Pat. No. 4,676,156 discloses a dampening apparatus for a printing press in which an additional lever is provided so as to operate a dampening system independent of the manupulation to the operating lever which controls an inking system and main operation of the offset printing press.

However, according to the offset press, two levers must be manipulated, and therefore, high maneuverability may not be attainable, and it would be rather difficult to obtain optimum manipulation timings with resect to the two levers.

SUMMARY OF THE INVENTION

It is therefore, an object of the present invention to overcome the above-described drawbacks and to provide an improved offset printing press having an improved operating lever mechanism capable of controlling sequential printing operations by manipulating a single operating lever.

In accordance with the present invention there is provided an offset printing press having a plate cylinder, a blanket cylinder, an impression cylinder, a paper feed mechanism including a suction feet and a pump drive motor for generating negative pressure in the suction feet, a printer drive motor, an inking roller system, a dampening roller system, the inking roller system including ink applicator rollers in contact with the plate cylinder, and the dampening roller system including a fountain roller, a metering roller in rotational contact with the fountain roller, a water distributor roller in rotational contact with the fountain roller, a water delivery roller in rotational contact with the water distributor roller, and a water applicator roller in rotational contact with the water delivery roller for applying water to the plate cylinder, the offset printing press comprising; a first pair of frames for rotatably supporting the inking roller system and for rotatably supporting the water delivery roller and the water applicator roller; a second pair of frames for rotatably supporting the metering roller, and the water distributor roller, the second pair of frames being pivotally connected to the first pair of frames by pivot pins, the fountain roller being provided coaxial with the pivot pins; first biasing means connecting between the first and second pair of frames for normally urging the second pair of frames toward a first direction so that the water distributor roller on the second pair of frames is brought into contact with the water delivery roller; an operation shaft rotatably extending through the first pair of frames; an operating lever fixely connected to the operating lever; a drive source drivingly connected to the fountain roller for rotating the same about its axis; gear trains for driving the metering roller and the water distributor roller in cooperation with the fountain roller; a positioning cam member fixedly connected to the operating shaft for defining a plurality of tilting stages of the operating lever; cam members rotatably supported to the first pair of frames; abutting members connected to the second pair of frames, said cam members being abuttable on the abutting members; and, first link members having one end portions rotatably connected to the operation shaft and another end portions rotatably connected to the cam members, the cam members urging the abutting members to pivot the second pair of frames in a second direction against biasing force of the first biasing means, so that the water distributor roller is moved away from the water delivery roller.

DETAILED DESCRIPTION OF THE PREFERRED EMBODIMENT

Figure 1:
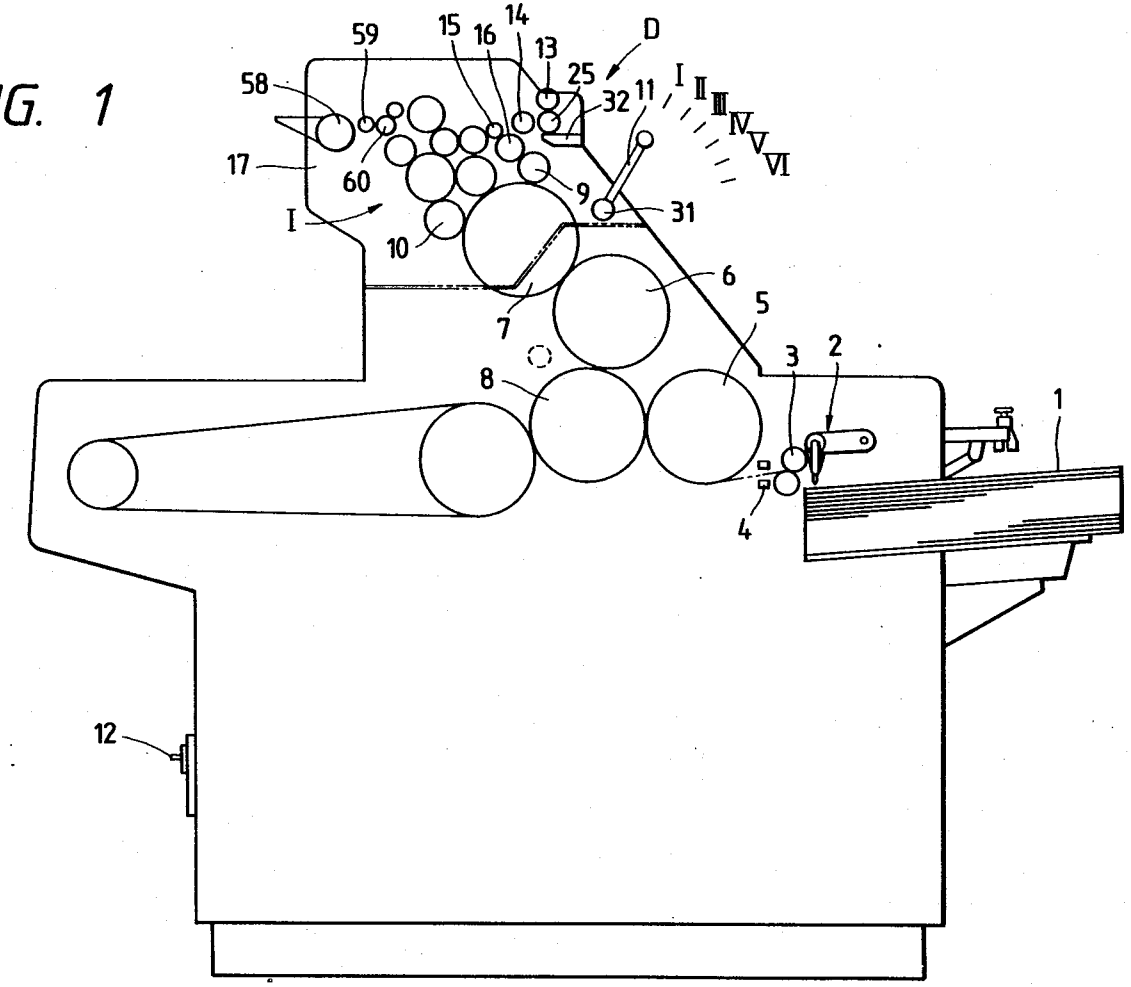
FIG. 1 is a schematic side elevation showing an offset printing press provided with a operating lever mechanism according to the present invention.
Figure 2:
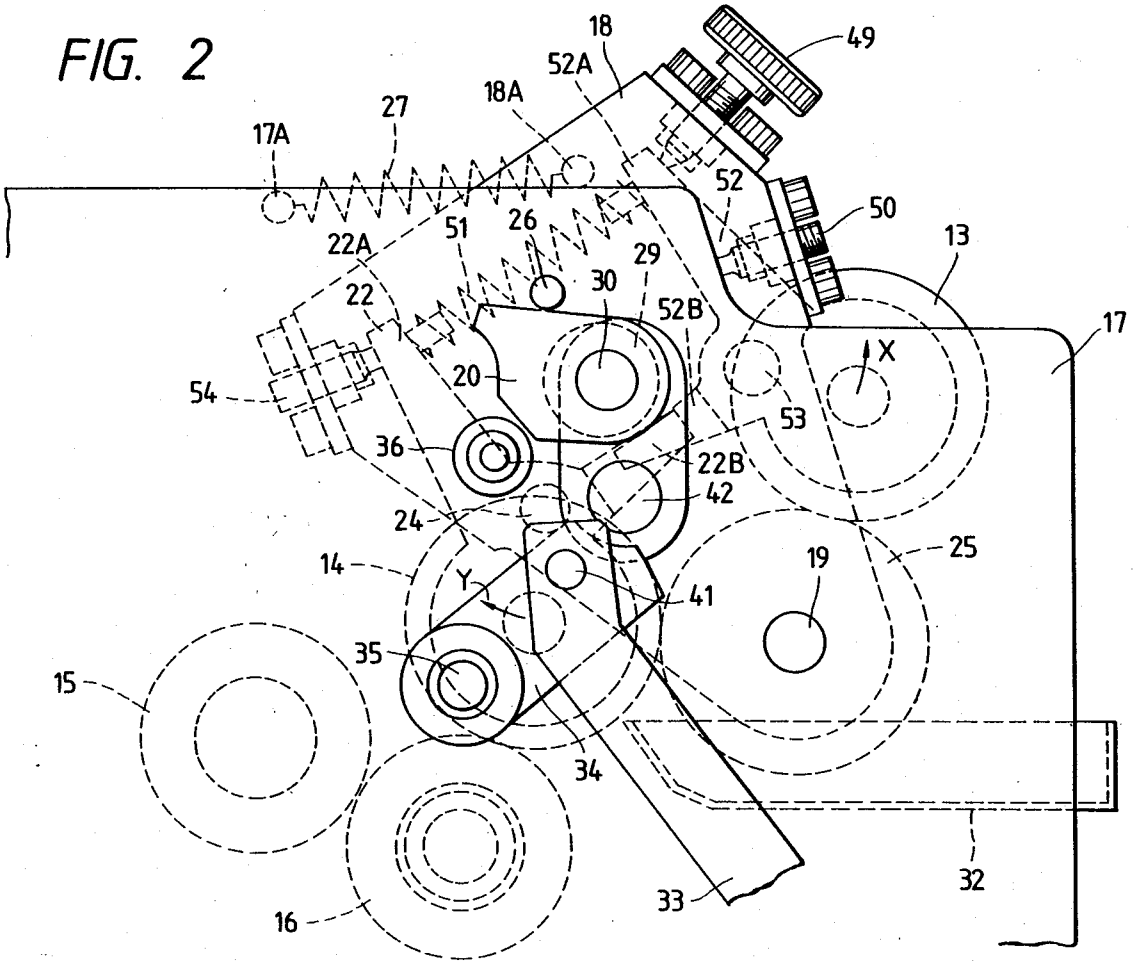
FIG. 2 is one side elevational view (manipulation side) showing an essential portion of the offset printing press, for particularly showing the operating lever mechanism according to one embodiment of this invention.

FIG. 1 generally shows an offset printing press provided with an operating lever mechanism according to one embodiment of this invention. As shown, the printing press includes a paper-feed cylinder 5, a blanket cylinder 6, a plate cylinder 7 for mounting thereon a master plate (not shown), an impression cylinder 8, an inking system I and a dampening system D in rotational contact with the plate cylinder 7. These cylinders and the inking system I are rotatably supported by a first pair of frames (inking roller frames) 17 and 17' (see FIG. 3).

The inking system I has an inking roller train which includes an ink supply roller 58, an ink ductor roller 59, ink distribution rollers 60, 60, and form rollers or ink applicator rollers 10, 10, so that an ink is coated onto an inking surface (not shown) of the plate cylinder 7 through the ink applicator rollers 10, 10. On the other hand, the dampening system D is adapted for applying dampening liquid such as water in a fountain pan 32 to the plate cylinder 7. The dampening system D is provided with a dampening roller train which includes a fountain roller or a dipping roller 25 rotatably supported by the first pair of frames 17, 17' and positioned above a fountain pan 32, a metering roller 13, a water distributor roller (dampening medium distributor roller) 14, a water delivery roller 16 and a water applicator roller 9. Further, the inking system and the dampening system are selectively communicated with each other by an ink transfer roller 15 which is disposed between the water delivery roller 16 and one roller of the ink roller train.

Figure 3:
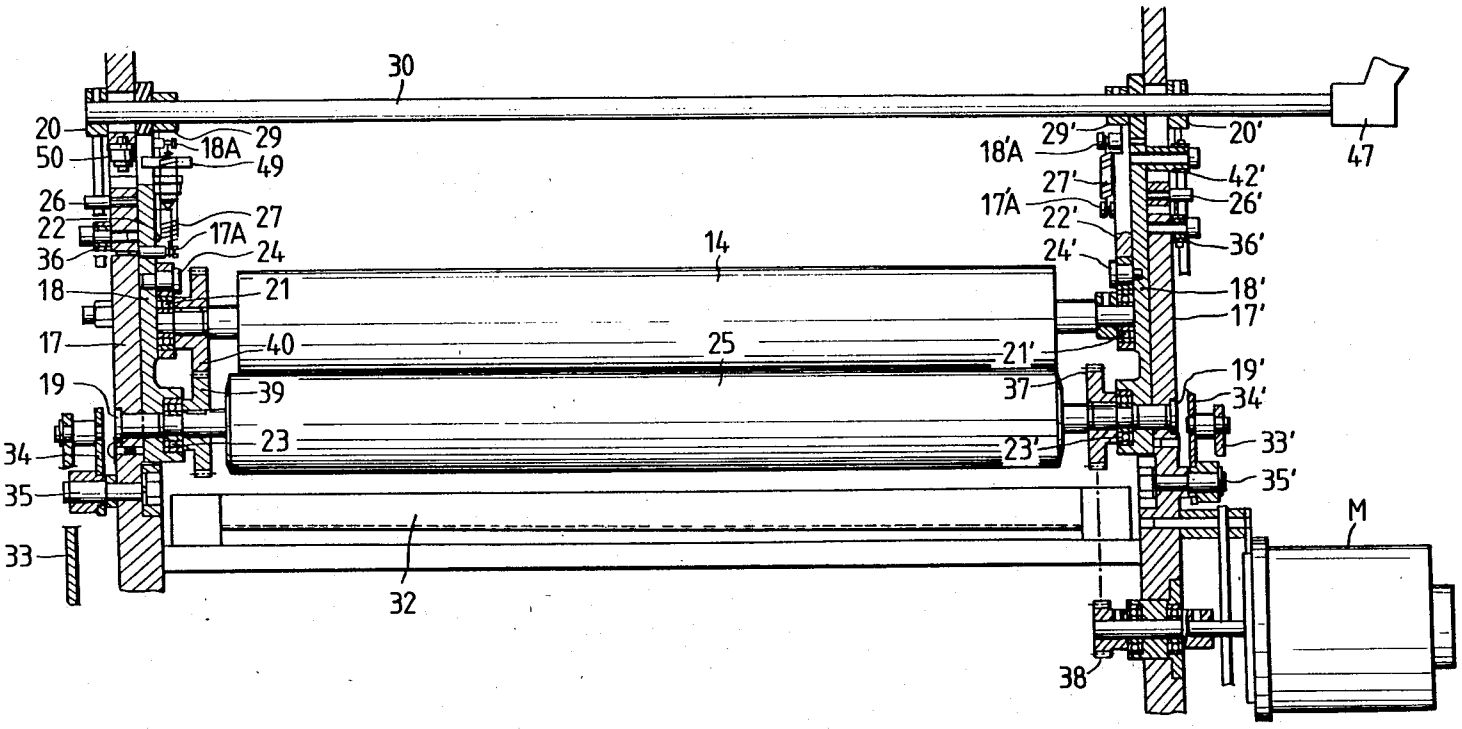
FIG. 3 is a cross-sectional plan view showing the operating lever mechanism according to one embodiment of this invention.

A main switch 12 is provided at a front side of the offset press for energizing a drive motor M (FIG. 3). Further, a printing sheet stack is disposable at a rear side of the offset press, and a suction foot 2 is provided at a position adjacent a leading edge portion of an uppermost printing sheet 1 of the sheet stack for feeding a single printing sheet 1 toward the paper-feed cylinder 5 via feed rollers 3. Furthermore, a sheet sensor 4 is provided at a sheet path defined between the feed rollers 4 and the paper-feed cylinder 5 for detecting the sheet 1. As is well known, an ink is applied from the inking system I onto the master plate on the plate cylinder 7, and the inked image is initially transferred onto the brancket cylinder 6. When the printing sheet 1 passes between the impression cylinder 8 and the brancket cylinder 6, the inked image on the brancket cylinder 6 is transferred onto the printing sheet 1.

In the present invention, provided are an operating lever 11 and an operation shaft 31 integrally connected thereto for controlling sequential printing operations of the offset printing press inclusive of the operations of the inking system I and the dampening system D.

Details of the operating lever mechanism will be described.

As shown in FIGS. 2 thru 6, a second frames (a pair of dampening roller frames) 18 and 18' are pivotally supported to a pair of inking roller frames 17 and 17' by pivot pins 19 and 19'. The dampening roller frames 18 18' rotatably support the fountain roller 25, the metering roller 13, and the water distributor roller 14, whereas the inking roller frames 17 17' rotatably support the water delivery roller 16, the water applicator roller 9, the ink transfer roller 15 and above described inking rollers such as rollers 58, 59, 60 and 10.

As shown in FIG. 3, the dampening roller frames 18, 18' are positioned inside the inking roller frames 17, 17', and are angularly pivotable within a predetermined range. Further, as best shown in FIGS. 1 and 3, tensile springs 27, 27' are provided having one ends secured to the dampening roller frames 18 18' (at 18A, 18'A) and another ends secured to the inking roller frames 17 17' (at 17A, 17'A) for biasing the dampening roller frames 18 18' toward a first direction (counterclockwise direction in FIG. 2).

The pivot pins 19 19' for pivotting the dampening frames 18 18' extend coaxially as shown in FIG. 3, and a shaft of the fountain roller 25 also extends coaxial with the pivot pins 19, 19'. The fountain roller 25 is rotatably supported by the frames 18 18' by means of bearings 23 23'.

However, the fountain roller 25 can also be supported to the frames 18 18' instead of the frames 17 17'. In any case the fountain roller 25 is provided coaxial with the pivot pins 19, 19'. A driven gear 37 is fixedly connected to and coaxial with the shaft of the fountain roller 25 at its one end portion as shown in FIG. 3, and the driven gear 37 is meshingly engaged with a drive gear 38 coupled to a motor shaft of the drive motor M which is energized upon ON state of the main switch 12 (FIG. 1). Since the pivotal axis of the frames 18 18' is coaxial with the shaft of the fountain roller 25, the axial position of the fountain roller 25 is not changeable. Therefore, the fountain roller 25 is rotatable about its axis by turning ON the main switch 12.

Further, at the another end portion of the shaft of the fountain roller 25, a gear 39 is fixedly provided. The gear 39 is meshingly engageable with a gear 40 fixedly secured to the shaft of the water distributor roller 14. Since the position of the water distributor roller 14 is changeable by the pivotal motion of the arms 22 22' about the pins 24 24', the gear 40 is selectively engaged with the gear 39. Similarly, the metering roller 13 can be drivingly rotatable about its axis because of a gear train (not shown). Accordingly, controlled amount of water in the fountain pan 32 can be applied to the plate cylinder 7 by the rotations of the fountain roller 25, the metering roller 13, the water distributor roller 14 and the water delivery roller 16.

Figure 4:
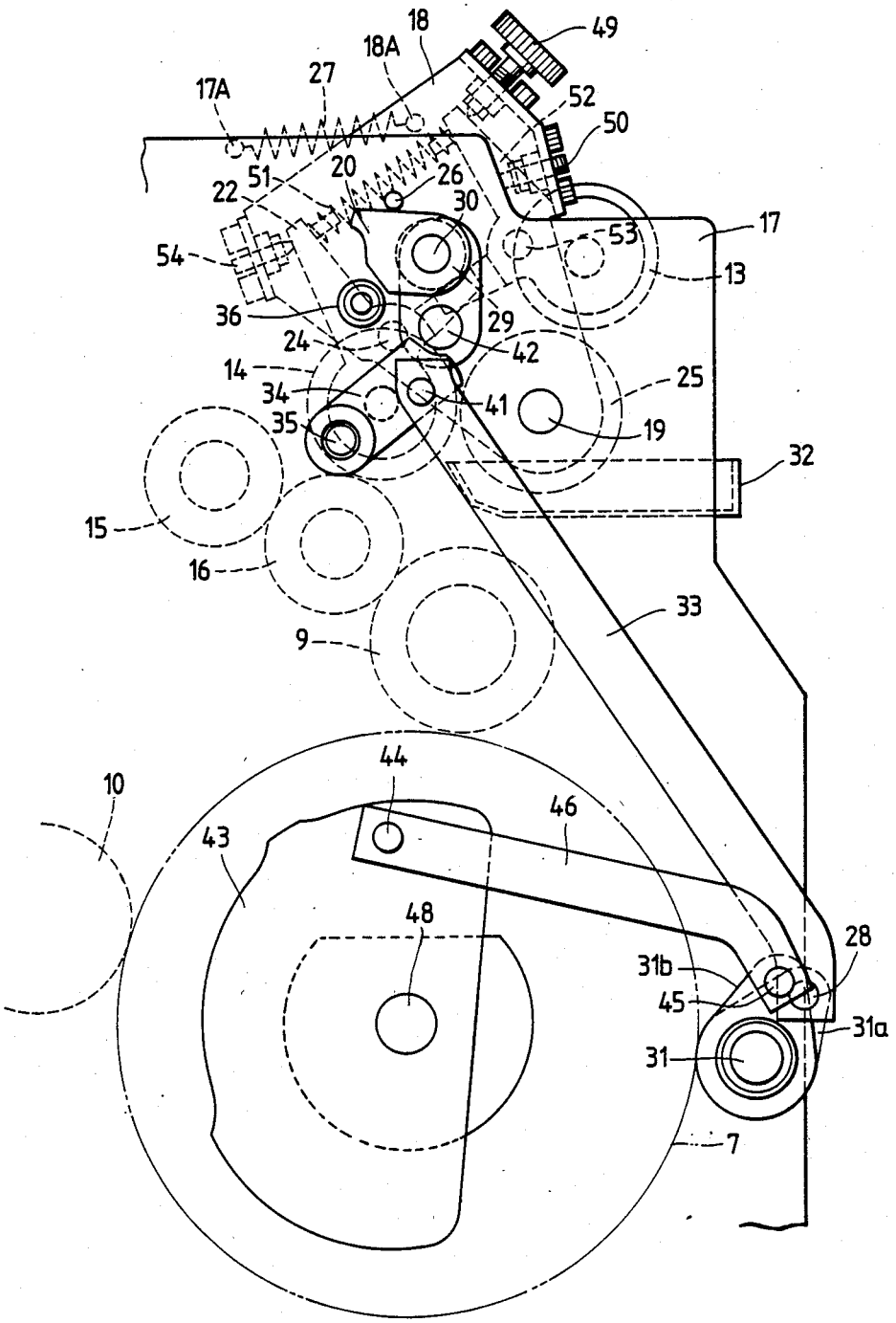
FIG. 4 is a one side elevational view showing the essential portion of the offset printing press for particularly showing the operating lever mechanism and a plate cylinder according to one embodiment of this invention.
Figure 5:
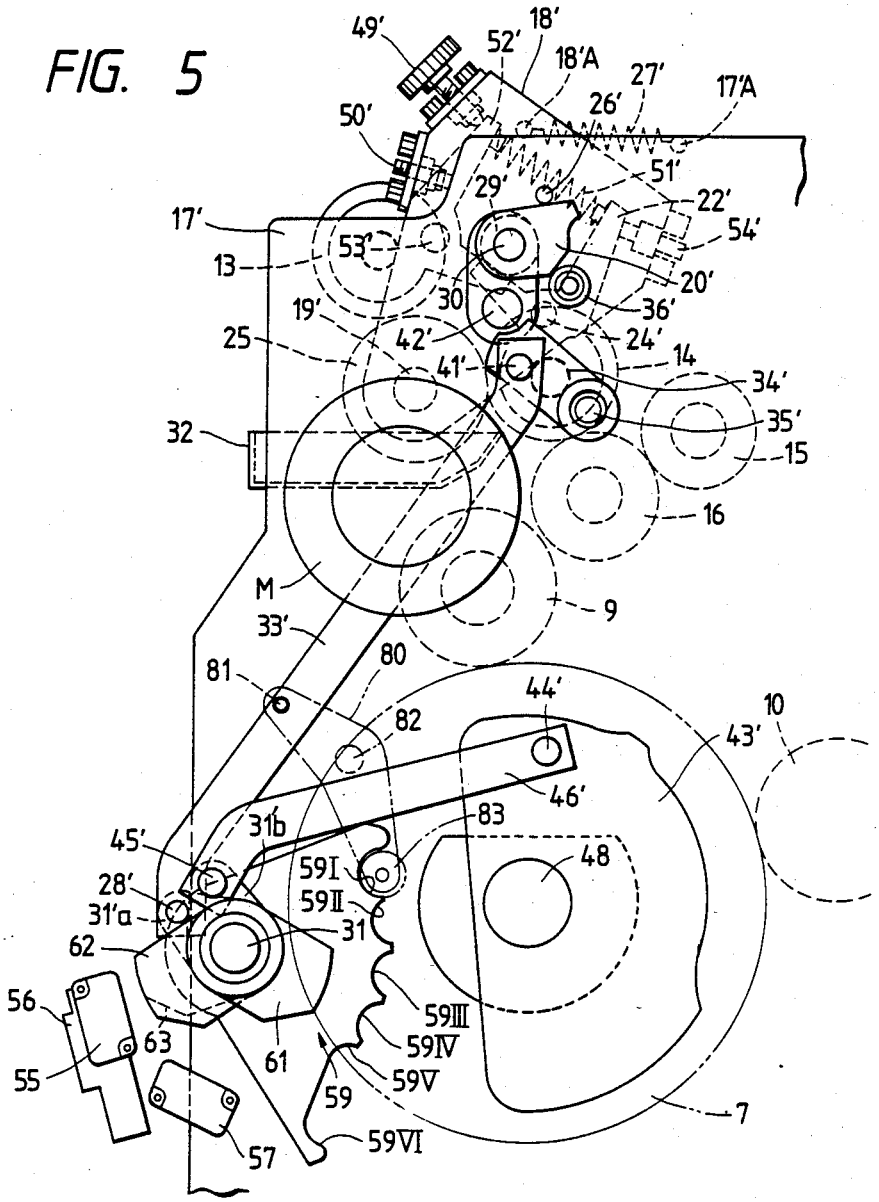
FIG. 5 is another side elevational view (non-manipulation side) showing the operating lever mechanism according to one embodiment of this invention.
Figure 6:
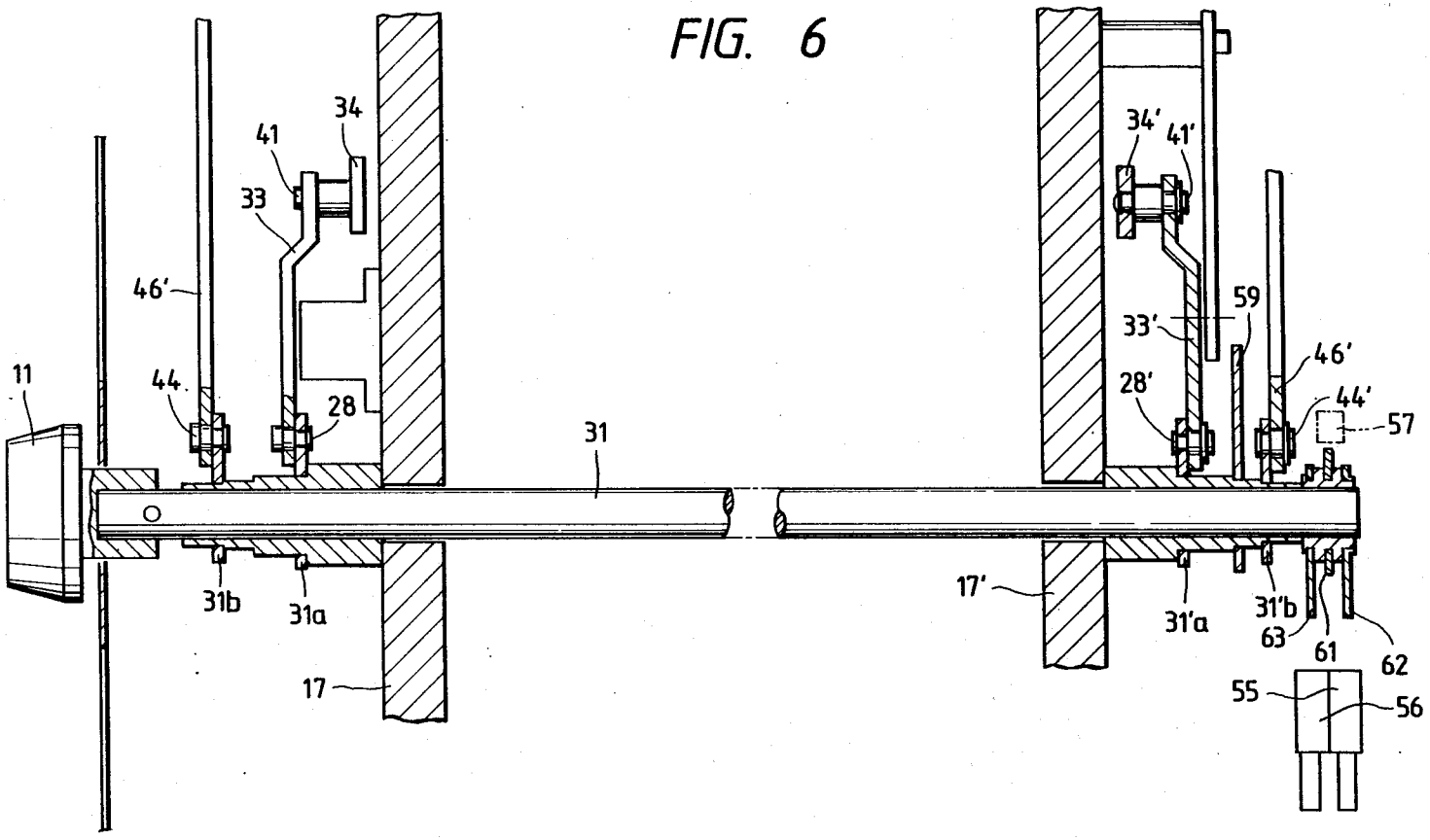
FIG. 6 is a plan view showing an operating lever and its associated components according to one embodiment of this invention; and, FIG. 7 is a operational time chart showing operational timings of an inking system and dampening system, actual printing timing, and ON/OFF timings of switches.

As best shown in FIG. 3, the operation shaft 31 extends through the frames 17 17', and as shown in FIGS. 4, 5 and 6, arms 31*a* 31*a'* are fixedly coupled to end portions of the operation shaft 31. The arms 31*a* 31*a'* are positioned outside the frames 17 17', and pins 28 28' extend from free end portions of the arms 31*a* 31*a'*. Further, pins 35 35' extend outwardly from the inking roller frames 17 17', and cams 34 34' are provided rotatable about the pins 35 35'. The cams 34 34' are integrally provided with pins 41 41' as best shown in FIG. 4. The cams 34 34' are abuttable onto rollers 42 42' rotatably extending from the dampening roller frames 18, 18'.

Link members 33 33' are provided for forcibly pivotting the dampening roller frames 18 18' about the pivot pins 19 19'. That is, the link members 33 33' have one end portions rotatably connected to the pins 28 28' of the arms 31*a* 31*a'*, and another end protions rotatably connected to the pins 41 41' of the cams 34 34'. Therefore, when the operation shaft 31 is rotated in one direction, the arm 31*a* 31*a'* are also moved, so that the link members 33 33' will pivot the cams 34 34' about the pins 35 35', and as a result, the cams 34 34' are brought into abutment with the rollers 42 42' connected to the dampening roller frames 18 18'. Accordingly, the dampening roller frames 18 18' are pivotted about the pivot pins 19 19' against the biasing force of the tensile springs 27 27' in a clockwise direction in FIG. 2.

Further, as shown in FIGS. 5 and 6, the operation shaft 31 is also fixed with switch cams 61, 62 and 63 for actuations of switchs and a positioning cam 59 for presenting stepping rotation of the operation shaft 31. The switch cam 61 is adapted to provide OFF state of a switch 57 during deenergization of a main printer drive motor (not shown), which switch 57 is adapted to provide ON/OFF states of the drive motor M (FIG. 3) which operates the fountain roller 25 as described above. The switch 57 is actuated when the offset printing press is at inoperable state (during OFF state of the main drive switch 12). On the other hand, the switch cam 62 is adapted to activate a switch 55 which energizes and deenergizes a suction pump motor (not shown) of the suction foot 2 and renders the paper feed mechanism inoperative. Furthermore, the switch cam 63 is adapted to activate a switch 56 which starts operation of the paper feed mechanism.

The plate cylinder 7 has a plate cylinder shaft 48 as shown in FIG. 4, and cam plates 43 43' are provided rotatable about the shaft 48. The cam plates 43 43' are integrally provided with pins 44 44'. On the other hand, the operation shaft 31 is further fixeded with arms **31*b* 31*b'* at positions outside the arms 31*a* 31*a'*. The free end portions of the arms 31*b* 31*b'* are integrally provided with pins 45 45'. Further, second link members 46 46' are provided for pivotting the cam plates 43 43' about the plate cylinder shaft 48. That is, the second link members 46 46' have one end portions rotatably connected to the pins 44 44' and another end portions rotatably connected to the pins 45 45'. Therefore, when the operation shaft 31 is rotated about its axis, the integral arms 31*b* 31*b'* are also moved to pivot the cam plates 43 43' about the shaft 48. Because the cam surfaces of the cam plates 43 43' are mechanically associated with the water applicator roller 9 and the ink applicator rollers 10 10, these rollers 9 and 10 10 are moved toward and away from the plate cylinder 7 in response to the pivotal motion of the cam plates 43 43'**.

Figure 7:
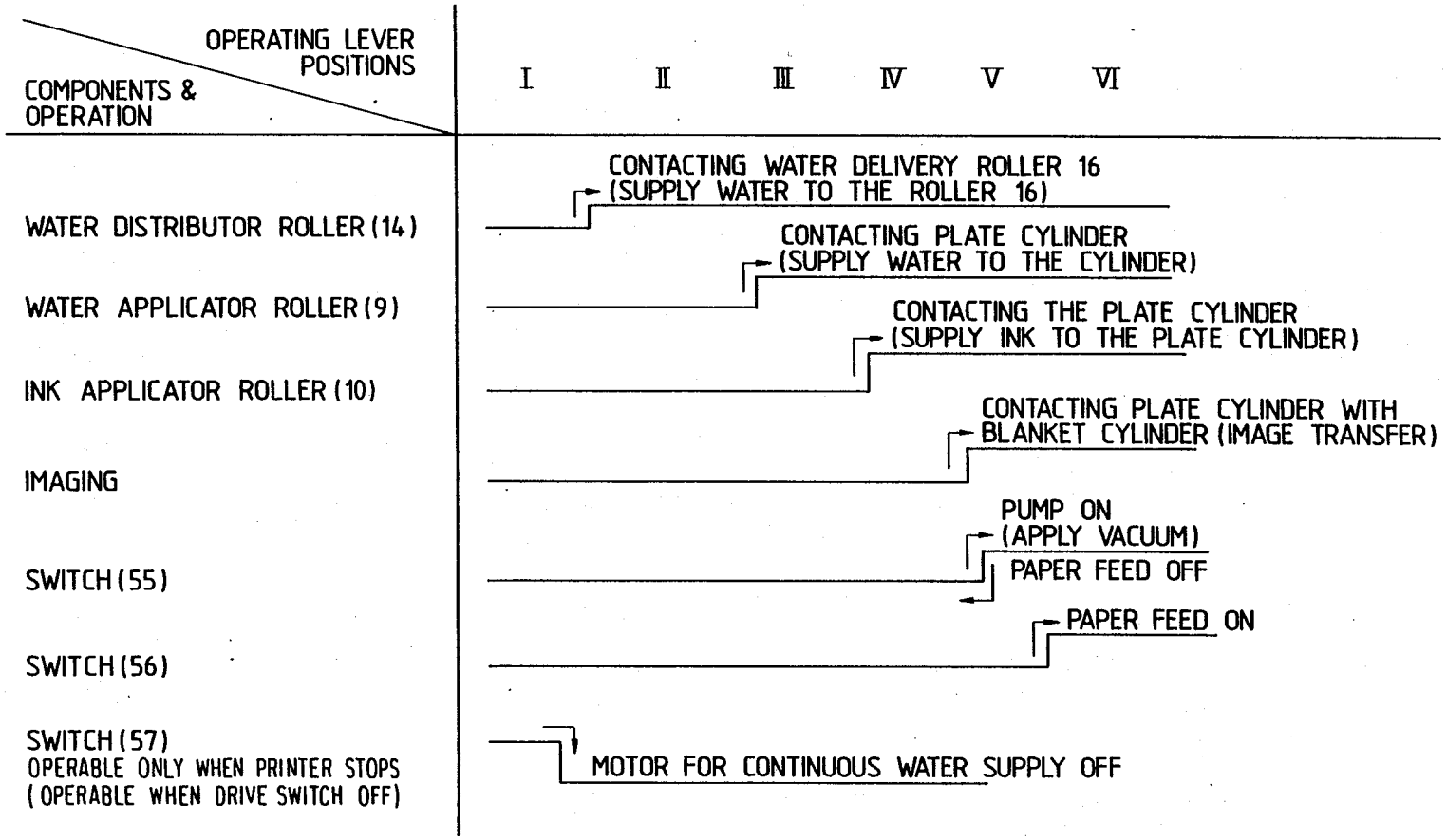

The positioning cam 59 fixedly connected to the operation shaft 31 is formed with a plurality of cam recesses 59I thru 59VI (the recesses 59V and 59VI can be referred to as a single elongated recess contiguous with each other) for defining six angular rotational positions of the shaft 31 as shown in FIGS. 6 and 7, to thus provide six tilting postures I thru VI of the operating lever 11 shown in FIG. 1. As shown in FIG. 5, a lever 80 is provided pivotable about a pin 82 extending from the inking roller frame 17'. The lever 80 has one end rotatably connected to the first lever member 33' and another end rotatably supporting a cam follower 83. The cam follower 83 is selectively engageable with one of the cam recesses formed at the cam plate 59 in response to the tiliting operation of the operating lever 11. Resistive force must be applied to the operating lever 11 so as to move the same from the first to second positions, from second to third positions, from third to fourth positions and from fourth to fifth positions, since the cam follower 83 must ride over the projections defined by neighbouring recesses. However, no resistive force is applied when the operating lever 11 is moved from its fifth position to the sixth position because the roller 88 can be moveable along the elongated recess without any obstacle.

Next, described will be a mechanism for temporarily releasing the matering roller 13 and the water distributor roller 14 relative to the fountain roller 25. This temporary releasing mechanism is advantageous for releasing pressure contact between these rollers when the offsent printing press is not used for a long duration.

Arms 22 22' are pivotally supported to the dampening roller frames 18 18' by pins 24 24', and another arms 52 52' are pivotally supported to the frames 18 18' by pins 53 53'. The arms 22 22' rotatably support the water distributor roller 14, and the arms 52 52' rotatably support the metering roller 13.

The arms 22 22' have one and another end portions with respect to the pins 24 24'. The one end portions are formed with bifurcated legs, and the opposite end portions are provided with ball bearings 21 21' (FIG. 3) for rotatably supporting a shaft of the water distributor roller 14. Similarly, the arms 52 52' have one and another end portions with respect to the pins 53 53'. The one end portions are formed with bifurcated legs, and the other end portions are provided with ball bearings (not shown in FIG. 3) for rotatably supporting a shaft of the metering roller 13.

The bifuracated leg portions of the arms 22 22' have first legs 22A 22A' and second legs 22B 22B'. Further, the bifurcated leg portions of the arms 52 52' have first legs 52A 52A' and second legs 52B 52B'. Between the first legs 22A 22A' and the first legs 52A 52A', compression springs 51 51' are interposed so as to move these leges away from each other. That is, in FIG. 2, because of the biasing force of the compression spring 51, the first leg 22A of the arm 22 is biased toward counterclosewise direction, and the first leg 52A of the arm 52 is biased toward clockwise direction.

Further, between the bifurcated spaces defined by the first and second legs, disposed are cams 29 29' fixed to a night-latch shaft 30 rotatably extending through the frames 18 18' and 17 17'. The second legs 22B 22B' and second legs 52B 52B' are in abutment with the rotating cams 29 29', so that the arms 22 22' and 52 52' can be pivotted about pins 24 24' and 53 53' against the biasing force of the compression springs 51 51'.

As shown in FIG. 3, these cams 29 29' are positioned inside the frames 18 18'. On the other hand, another cams 20 20' are fixed to the shaft 30 at positions outside the frames 17 17'. Further, pins 26 26' and rollers 36 36' extend outwardly from the frames 17 17' at positions to abut the cams 20 20'. Therefore, the rotation of the shaft 30 about its axis is restricted to a certain range because of the abutment between the cams 20 20' and one of pins 26 26' and the rollers 36 36'.

When the cams 29 29' depressingly abut the second legs 22B 22B' and 52B 52B', the arms 22 22' and 52 52' are pivotted about pins 24 24' and 54 54' against the biasing forces of the compression springs 51 51'. In this case, the water distributor roller 14 supported to the arm 22 22' and the metering roller 13 supported to the arms 52 52' are moved in directions indicated by arrows X and Y, repsectively. As a result, the rollers 13 and 14 are positioned away from the fountain roller 25.

On the other hand, when the cams 29 29' are further rotated for releasing depression to the second legs 22B 22B' and 52B 52B', the arms 22 22' and 52 52' are pivotted in opposite directions because of the biasing force of the compression springs 51 51'. In this case, the water distributor roller 14 and the metering roller 13 are brought into intimate contacts with the fountain roller 25 as shown by broken lines in FIG. 2.

As shown in FIG. 3, one end of the night-latch shaft 30 is coupled to a manual knob 47 for rotating the shaft 30 about its axis. This rotation of the shaft 30 will provide the rotations of the cams 29 29', so that the arms 52 52' and 22 22' are pivotted about the pins 53 53' and 24 24' in order to forcibly move the metering roller 13 and the water distributor roller 14 away from the fountain roller 25 in case the offset printing press is not used for a long period. As a result, these rollers 25 14 and 13 can provide long service life.

First adjusting screws 49 49' and second adjusting screws 54 54' are provided at the dampening roller frames 18 18' for controlling pivotting angles of the arms 52 52' and 22 22'. That is, the first adjusting screws 49 49' are movable in axial directions by threading rotations thereof, and distal ends of the screws 49 49' are abuttable on the first legs 52A 52A'. Therefore, when the screws 49 49' are advanced, the screws 49 49' can urge the arms 52 52' against the biasing force of the compression springs 51 51', so that the metering roller 13 can be moved away from the fountain roller 25. Therefore, contacting pressure between the metering roller 13 and the fountain roller 25 is controllable by the threading rotations of the screws 49 49'. Further, the second adjusting screws 54 54' are movable in axial directions by threading rotations thereof, and distal ends of the screws 54 54' are abuttable on the first legs 22A 22A'. Therefore, when the screws 54 54' are advanced, these screws can urge the arms 22 22' against the biasing force of the compression springs 51 51', so that the water distributor roller 14 is moved away from the fountain roller 25. Therefore, contacting pressure between the water distributor roller 14 and the fountain roller 25 is controllable by the threading rotations of the screws 54 54'.

Furthermore, third adjusting screws 50 50' are provided at the dampening roller frames 18 18'. The third adjusting screws 50 50' are movable in axial directions by threading rotations thereof, and distal ends of the adjusting screws 50 50' are abuttable on end faces of the inking roller frames 17 17'. Therefore, the pivotting angle of the dampening roller frames 18 18' about the pivot pins 19 19' are controlled. That is, if the screws 50 50' are rotationally advanced, the dampening roller frames 18 18' are pivotted about the pins 19 19' in the second direction (clockwise direction in FIG. 2) against the biasing force of the tensile springs 27 27'. As a result, the water distributor roller 14 is moved away from the water delivery roller 16. Therefore, by the rotation of the third screws 50 50', contacting pressure between the water distributor roller 14 and the water delivery roller 16 is controllable.

With the structure, when the cam follower 83 is engaged with the first recesses 59I of the positioning cam 59 to provide a first lever position I in FIG. 1 (this first position I is a stand-by position of the offset printing press), the operating shaft 31 and the first links 33 and 33' do not move the cams 34 34', but the cams 34 34' are maintained at positions to urge the rollers 42 42', so that the dampening roller frames 18 18' are maintained at a pivot position where the water distributor roller 14 is positioned remote from the water delivery roller 16. With maintaining this state, when the main switch 12 is turned ON, the motor M is energized so that the fountain roller 25, the metering roller 13 and the water distributor roller 14 are drivingly rotated, whereby water in the fountain pan 32 is travelled to the water distributor roller 14. During this water travel, adjusting screws 49 49' and 54 54' are controlled so as to control water delivering amount to the water distributor roller 14.

When the operating lever 11 is tilted, the cam follower 83 is comming into engagement with the second recess 59II to define the second operating lever position II. By the angular movement of the arm **31*a* 31*a'*, the first lever 33 33' pull the cam 34 34' to pivot the same abut the pins 35 35' so that the cams 34 34' are moved away from the rollers 42 42' of the dampening roller frames 18 18'. Therefore, the frames 18 18' can be pivotted about pivot pins 19 19' in the first direction by the biasing force of the tensile springs 27 27' to obtain their angular positions shown in FIG. 2. As a result, the water distributor roller 14 is brought into contact with the water delivery roller 16, and accordingly water can be applied to the plate cylinder 7 through the water applicator roller 9. In this case, the water transferring amount from the water distributor roller 14 to the water delivery roller 16 can be controlled by controlling the threading amount of the adjusting screws 50 50'**.

In the second lever position II, the switch cam 61 fixedly connected to the operation shaft 31 renders the switch 57 OFF. Therefore, in a case where the main printer motor (not shown) is deenergized and the water delivery roller 16 is not rotated about its axis, the drive motor M is also deenergized because of OFF state of the switch 57. Accordingly, any damage to the water delivery roller 16 and the water distributor roller 14 due to the forcible rotational contact therebetween can be prevented.

When the operating lever 11 is further shifted and fixed at its third position III by the engagement of the cam follower 83 with the third recess 59III of the positioning cam 59, the cam plates 43 43' are pivotted about the shaft 48 of the plate cylinder 7 by way of the second links 46 46' because of the movement of the arms **31*b* 31*b'*. Therefore, the water applicator roller 9 is brought into contact with the plate cylinder 7, so that water is coated onto the master plate mounted over the plate cylinder 7**.

When the operating lever 11 is further tilted and fixed at the fourth lever position IV, the positioning cams 43 43' are further pivotted by way of the second links 46 46'. Therefore, the ink applicator rollers 10 10 are brought into contact with the plate cylinder 7 for applying ink over the master plate.

When the operating lever 11 is further tilted at the fifth lever position V where the cam follower 83 is engaged with a leading edge portion of the fifth recess 59V–59VI, inked image on the master plate is transferred onto the blanket cylinder 6 similar to the conventional offset printing press because of the rotational contact of the plate cylinder 7 with the blanket cylinder 6. In this instance, the switch cam 62 fixedly secured to the operation shaft 31 turns the switch 55 ON, so that the suction pump motor (not shown) is energized for initiating sucking operation of the suction foot 2.

When the operating lever 11 is further tilted without any resistive force because of the contiguous elongated recess 59V-59VI, the lever 11 is brought to the sixth lever position VI where the cam follower 83 is engaged with a trailing end portion of the fifth recess 59V–59VI. In this case, the switch cam 63 fixedly secured to the operation shaft 31 renders the switch 56 ON, so that the paper feed mechanism is operated. That is, the sheet 1 is delivered into the feed rollers 3 and is transferred, through the paper-feed cylinder 5, into a space defined between the impression cylinder 8 and the brancket cylinder 6 which carries thereon the transferred inked image. Therefore, the image on the brancket cylinder 6 is transferred onto the printing sheet 1.

If the offset printing press is not intended to be operated for a long duration, the manual knob 47 is rotated, so that the arms 52 52' and 22 22' are pivotted, to thereby move the metering roller 13 and the water distributor roller 14 away from the fountain roller 25. As a result, minute pressure deformations of these rollers and any degradation thereof attendant to the long term pressure contact between the rollers can be prevented.

As described above according to the present invention, the fountain roller 25, the metering roller 13 and the water distributor roller 14 those being rotatably supported by the dampening roller frames 18 18' are movable toward and away from the water delivery roller 16 rotatably supported by the inking roller frames 17 17' because of the pivotal motion of the dampening roller frames 18 18' casued by the manipulation of the operating lever 11. Therefore, water application from the fountain pan 32 to the water applicator roller 9 can be suspended by the operation of the lever 11, to thereby prevent the water from being excessively supplied to the plate cylinder 7. Further, the pivotal motion of the dampening roller frames 18 18' can be provided by the single operating lever 11, which simultaneously controls sequential printing operations. In the sequential operations, the operating lever 11 can prevent the water applicator roller 9 from being contacted with the plate cylinder 7 if the dampening roller system is at non-operative state, and further, the operating lever 11 can promptly provide activation of the dampening roller system. Therefore, in the present invention, high operability results in accordance with the operation to the single operating lever, and accurate water application timing is attainable in the sequential printing operations.

While the invention has been described in detail and with reference to specific embodiment thereof, it would be apparent for those skilled in the art that various changes and modifications can be made therein without departing from the spirit and scope of the invention.

What is claimed is:

1. An offset printing press having a plate cylinder, a blanket cylinder, an impression cylinder, a paper feed mechanism including a suction foot and a pump drive motor for generating negative pressure in the suction foot, a printer drive motor, an inking roller system, a dampening roller system, the inking roller system including ink applicator rollers in contact with the plate cylinder, and the dampening roller system including a fountain roller, a metering roller in rotational contact with the fountain roller, a water distributor roller in rotational contact with the fountain roller, a water delivery roller in rotational contact with the water distributor roller, and a water applicator roller in rotational contact with the water delivery roller for applying water to the plate cylinder, each of said cylinders having a shaft and each of said rollers having an axis about which it may be rotated, the offset printing press comprising;

a first pair of frames for rotatably supporting said inking roller system and for rotatably supporting said water delivery roller, said water applicator roller, said plate cylinder, said blanket cylinder, and said impression cylinder;

a second pair of frames for rotatably supporting said metering roller, and said water distributor roller, said second pair of frames being pivotally connected to said first pair of frames by pivot pins, said pivot pins being aligned to define a pivoting axis, the axis of rotation of said fountain roller being coaxial with said pivoting axis defined by said pivot pins;

first biasing means connected between said first and second pair of frames for normally urging said second pair of frames toward a first direction so that said water distributor roller on said second pair of frames is brought into contact with said water delivery roller;

an operation shaft rotatably extending through said first pair of frames;

an operating lever fixedly connected to said operation shaft;

a drive source drivingly connected to said fountain roller for rotating said fountain roller about its axis of rotation;

gear trains for driving said metering roller and said water distributor roller to rotate, each about its axis of rotation, in cooperation with said fountain roller;

a positioning cam member fixedly connected to said operation shaft for defining a plurality of tilting stages of said operating lever;

a plurality of cam members rotatably supported by said first pair of frames;

abutting members connected to said second pair of frames, said cam members being abuttable on said abutting members; and a plurality of first link members each having first and second end portions said first end portion being rotatably connected to said operation shaft and said second end portion being rotatably connected to one of said cam members, so that said cam members may be brought into abutment with said abutting members to pivot said second pair of frames in a second direction against the biasing force of said first biasing means, so that said water distributor roller is moved away from said water delivery roller.

2. The offset printing press as defined in claim 1, wherein said fountain roller is rotatably supported by said second pair of frames.

3. The offset printing press as defined in claim 1, further comprising:

cam plates rotatably provided on said shaft of said plate cylinder;

second link members having first and second end portions said first end portion being rotatably connected to said operation shaft and said second end portion rotatably connected to said cam plates, said water applicator roller and said ink applicator rollers being mechanically connected to said cam plates and movable toward and away from said plate cylinder in response to pivotal motion of said cam plates.

4. The offset printing press as defined in claim 1, wherein said metering roller is pivotally supported by said second pair of frames, which provide a first position where said metering roller is in rotational contact with said fountain roller and a second position where said metering roller is moved away from said fountain roller, and wherein said water distributor roller is pivotally supported by said second pair of frames, which provide a first position where said water distributor roller is in rotational contact with said fountain roller and a second position where said water distributor roller is moved away from said fountain roller.

5. The offset printing press as defined in claim 4, said press further comprising:

first arms pivotally supported by said second pair of frames for pivoting said water distributor roller;

second arms pivotally supported by said second pair of frames for pivoting said metering roller;

second biasing means connected between said first and second arms for providing a biasing force, normally maintaining said water distributor roller and said metering roller in said first position;

a night-latch shaft extending between said second pair of frames, said shaft having one end provided with a manually rotatable knob; and, cam pieces fixedly connected to said night-latch shaft and in rotational contact with said first and second arms such that manually rotating such knob brings said cam pieces into rotational contact with said arms and pivots said water distributor roller and said metering roller against said second biasing force and into such second position, whereby said water distributor roller and said metering roller are forcibly separated from said fountain roller.

6. The offset printing press as defined in claim 5, further comprising:

first means for controlling contact pressure between said water distributor roller and said fountain roller, said first means being provided between said second pair of frames and said first arms;

second means for controlling contact pressure between said metering roller and said fountain roller, said second means being provided between said second pair of frames and said second arms; and, third means for controlling contact pressure between said water distributor roller and said water delivery roller, said third means being provided between said second pair of frames and said first pair of frames.

7. The offset printing press as defined in claim 3, further comprising:

a first switch being adapted to energize and deenergize said drive source;

a second switch which is connected to said paper feed mechanism and said pump drive motor, said second switch being adapted to energize and deenergize said pump motor and to terminate operation of said paper feed mechanism;

a third switch which is connected to said paper feed mechanism, said third switch being adapted to initiate said operation of said paper feed mechanism;

a first switch cam fixedly connected to said operation shaft, said first switch cam being abutable on said first switch, and said first switch being turned OFF upon departure of said first switch from said first switch cam when said printer drive motor is not energized for providing deenergizing state of said drive source;

a second switch cam fixedly connected to said operation shaft, said second switch cam being abuttable on said second switch; and, a third switch cam (63) fixedly connected to said operation shaft, said third switch cam being abuttable on a third switch.

8. The offset printing press as defined in claim 7, wherein said positioning cam member, fixedly connected to said operation shaft, is formed with a plurality of recesses for providing first to sixth tilting postures of said operating lever; and wherein in said first tilting posture, said water distributor roller is positioned away from said water delivery roller, because of abutment of said cam members, rotatably supported by said first pair of frames, with said abutting members for urging said second pair of frames toward said second direction;

in said second tilting posture, said water distributor roller is brought into contact with said water delivery roller because of said biasing force of said first biasing means;

in said third tilting posture, said water applicator roller is brought into contact with said plate cylinder because of said pivotal motion of said cam plates, rotatably attached to said plate cylinder and mechanically linked to said water applicator roller;

in said fourth tilting posture, said ink applicator rollers are brought into contact with said plate cylinder because of said pivotal motion of said cam plates, rotatably attached to said plate cylinder and mechanically linked to said ink applicator rollers;

in said fifth tilting posture, said plate cylinder and said blanket cylinder are contacted with each other, and at said same time negative pressure is generated in said suction foot because of abutment of said second switch cam with said second switch; and, in said sixth tilting posture, a printing paper is introduced between said blanket cylinder and said impression cylinder because of abutment of said third switch cam with said third switch.

* * * * *